US006085057A

United States Patent [19]

Matsuzoe et al.

[11] Patent Number: 6,085,057

[45] Date of Patent: Jul. 4, 2000

[54] IMAGE FORMING DEVICE AND METHOD FOR TRANSFERRING A TONER IMAGE ONTO A RECORDING MEDIUM

[75] Inventors: Hisanobu Matsuzoe, Chikushino; Yasunori Sagara, Kasuga; Masashi Ogawa, Kasuga; Yusuke Shiibara, Kasuga; Shinichi Kizu, Fukuoka; Kouji Migita, Fukuoka; Yukinori Hara, Fukuoka, all of Japan

[73] Assignee: Matsushita Electric Industrial Co., Ltd., Osaka, Japan

[21] Appl. No.: 09/284,385

[22] PCT Filed: Oct. 6, 1997

[86] PCT No.: PCT/JP97/03560

§ 371 Date: Apr. 12, 1999

§ 102(e) Date: Apr. 12, 1999

[87] PCT Pub. No.: WO98/34161

PCT Pub. Date: Aug. 6, 1998

[30] Foreign Application Priority Data

Feb. 4, 1997 [JP] Japan ..... 9-021195

[51] Int. Cl.[7] ..... G03G 15/16

[52] U.S. Cl. ..... 399/297; 399/298

[58] Field of Search ..... 399/223, 228, 399/297, 298

[56] References Cited

U.S. PATENT DOCUMENTS

| | | | |
|---|---|---|---|
| 4,855,784 | 8/1989 | Bujese | 399/297 |
| 5,216,453 | 6/1993 | Itoh | 399/297 |
| 5,587,779 | 12/1996 | Heeren et al. . | |
| 5,819,133 | 10/1998 | Matsuzoe et al. | 399/297 X |

FOREIGN PATENT DOCUMENTS

| | | |
|---|---|---|
| 0 698 833 | 2/1996 | European Pat. Off. . |
| 58-75168 | 5/1983 | Japan . |
| 60-191053 | 12/1985 | Japan . |
| 5-35038 | 2/1993 | Japan . |
| 8-314291 | 11/1996 | Japan . |
| 9-44054 | 2/1997 | Japan . |

OTHER PUBLICATIONS

Japanese language search report for Int'l Appln No. PCT/JP97/03560 dated Oct. 28, 1997.

English translation of Japanese search report.

*Primary Examiner*—William J. Royer
*Attorney, Agent, or Firm*—Ratner & Prestia

[57] ABSTRACT

An image forming device and an image forming method for transporting a toner image on an endless belt shaped toner image transporting member. The toner image transporting member is supported by a plurality of rollers and is stretched out and made rotatable in the same direction as the recording medium is transported. The colored toner is transported on the outside of the toner image transporting member and is transferred onto stationary recording medium by an opposed image transferring roller while the rotation of the toner image transporting member is suspended. The image transferring process is repeated for the required number of colors.

23 Claims, 6 Drawing Sheets

IMAGE FORMING DEVICE AND METHOD FOR TRANSFERRING A TONER IMAGE ONTO A RECORDING MEDIUM

This application is a U.S. National Phase Application of PCT International Application PCT/JP97/03560.

FIELD OF THE INVENTION

The present invention relates to an image forming device and an image forming method for transferring toner images directly onto a printing paper from a toner image transporting member not via the medium of an intermediate image transferring member and the like.

BACKGROUND OF THE INVENTION

In recent years an image forming device using a toner system as exemplified by a laser printer has been widely used to make it possible to produce clear images with excellent resolution. Among the image forming devices using a toner system, as mentioned in the above, there are signs of change with the advent of models that can handle color images.

A description will be made of a prior art image forming device for forming color images.

FIG. 9 is a perspective view of a prior art image forming device that is in a state of performing an image transferring process. In FIG. 9, a photosensitive belt 101 is one form of the toner image transporting members and is coated with a layer of an organic photoconductive material on the surface thereof. The photosensitive belt 101 thus prepared rotates in the direction indicated by an arrow, thereby an image in each respective color out of the four primary colors, i.e., cyan, magenta, yellow and black, being formed in succession. Next, a series of the steps for forming color images will be described.

The photosensitive belt 101, the surface of which is uniformly charged to about −600 V by a charging means, is irradiated with laser light according to image signals from a light exposure making means 102 constructed by such an optical system as a laser irradiation unit, a polygon mirror and the like. The surface potential of the area exposed to the laser light is raised to around −100 V and an electrostatic latent image is formed on the surface of the photosensitive belt 101. An image developing means 103 is formed of four sections for each respective primary color, i.e., an image developing means 103C for cyan, an image developing means 103M for magenta, an image developing means 103Y for yellow and an image developing means 103B for black, each performing an image developing process for one color out of the four primary colors by the use of primary color toner contained in each respective section of the above.

For example, when an image developing process for an image in cyan is performed, a development roller of the image developing means 103C attached with negatively charged toner is pressed onto the photosensitive belt 101 to convert the electrostatic latent image into a visible image, transferring toner onto the surface of the photosensitive belt 101 in an area, where the electrostatic latent image has been formed. Thus, a toner image in cyan is formed. Then, the toner image in cyan formed on the photosensitive belt 101 is transferred onto an intermediate image transferring member 104. After the above image transferring, the toner that has remained on the surface of the photosensitive belt 101 is eliminated by a cleaning means.

A series of the foregoing steps are repeatedly performed for cyan, magenta, yellow and black in this order and a colored toner image 105 with the four primary colors combined is formed on the intermediate image transferring member 104. Then, the toner image 105 formed on the surface of the intermediate image transferring member 104 is transferred onto a printing paper 107 via pressure from the image transferring roller 106. At this time, the intermediate image transferring member 104 is rotated in the direction, in which the printing paper 107 is transported.

After the image transferring, the toner having remained on the intermediate image transferring member 104 is eliminated by a cleaning means. Finally, an image fixing means 108 places the printing paper 107 transferred with the toner image 105 between a pressure applying roller 109 and a heat applying roller 110 provided with a heat source inside, thus having a color image fixed onto the printing paper 107 by fusing toner particles into place.

However, the prior art image forming device as described in the above requires without fail the intermediate image transferring member 104 in order to form a color image and the size of the device is made large and the mechanism is made complex, resulting in an increase of component counts just because of the existence of the intermediate image transferring member 104, thereby making it difficult to reduce the size of the image forming device.

DISCLOSURE OF THE INVENTION

The object of the present invention is to deal with the foregoing problem and to realize an image forming device with a smaller main body by eliminating an intermediate image transferring member.

In order to achieve the above object, the image forming device of the present invention comprises:

a plurality of rollers;

a rotatable and loop-like belt shaped toner image transporting belt supported by the plurality of rollers;

colored toner for the toner image transporting belt to transport a colored toner image; and an opposed image transferring roller installed on the inner side of the loop-like belt shaped toner image transporting belt, in which the toner image transporting belt is rotatable in the same direction as a record medium in transit is transported; and the color toner image which is transported on the outer surface of the toner image transporting belt is transferred onto the record medium by means of the opposed image transferring roller while the rotation of the toner image transporting belt is suspended.

Another image forming device of the present invention comprises:

(a) a loop-like belt shaped toner image transporting belt to transport a toner image;

(b) a plurality of rollers to support and rotate the toner image transporting belt;

(c) a toner attaching means to have colored toner attached on the outer surface of the toner image transporting belt and have a toner image transported; and (d) an opposed transferring roller installed on an inner side of the toner image transporting belt in such a way as the toner image transporting belt is pressed down on the record medium and also made movable.

An image forming method of the present invention comprises the steps of:

(a) forming a first colored toner image of a plurality of colored toner images, each having a color different from one another, on a surface of a rotatable loop-like toner image transporting belt; and (b) forming a first composite color image on the surface of the record medium by moving the toner image transporting belt by rolling with a pressing force applied thereto to transfer the first colored toner image from the toner image transporting belt to the record medium while a rotation of the toner image transporting belt being suspended.

According to the structure as described in the above, a small sized image forming device is realized and further the toner image transferring efficiency is enhanced, thereby enabling the realization of enriched images.

PREFERRED EXEMPLARY EMBODIMENT OF THE INVENTION

A description will be made on an exemplary embodiment of the present invention in the following:

If a brief description is made on an exemplary embodiment of the present invention, every time when an image developing process for one color is finished by each respective image developing means for a plurality of colors, the rotation of a toner image transporting member is suspended and an opposed image transferring roller is moved so as to rub a toner image of the toner image transporting member against a stationary printing paper, thereby transferring a toner image of a specific color onto the printing paper directly. This transferring process is repeated for each respective color by the number of times that correspond to the number of kinds of colors used to form a colored toner image on the printing paper. Then, the colored toner image on the printing paper is fixed by an image fixing means.

Accordingly, the bulky intermediate transferring member, which has been needed without fail in a prior art image forming device, can be eliminated, leading to simplification of the structure itself with a resulting reduction in size of the device. Since the image transferring efficiency per one time of toner transferring is about 90% and a toner image is transferred from the toner image transporting member directly to the printing paper without the intermediate image transferring member, thereby reducing the steps needed in toner image transferring. As a result, the reduction in the image transferring efficiency of toner can be eventually prevented.

Next, a detailed description will be made on an exemplary embodiment of the present invention with reference to FIG. 1 to FIG. 8.

Figure 1:
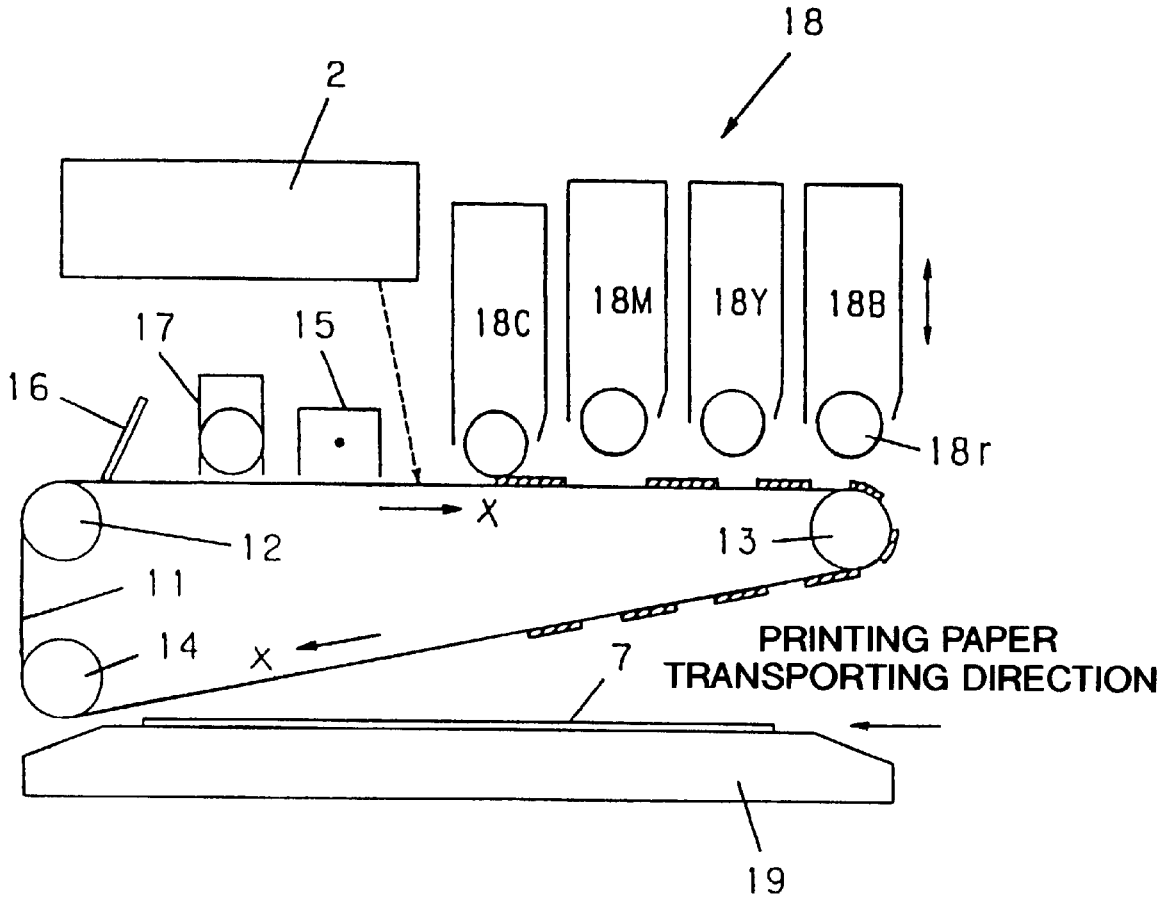
FIG. 1 is a schematic diagram of an image forming device in an exemplary embodiment of the present invention.
Figure 2:
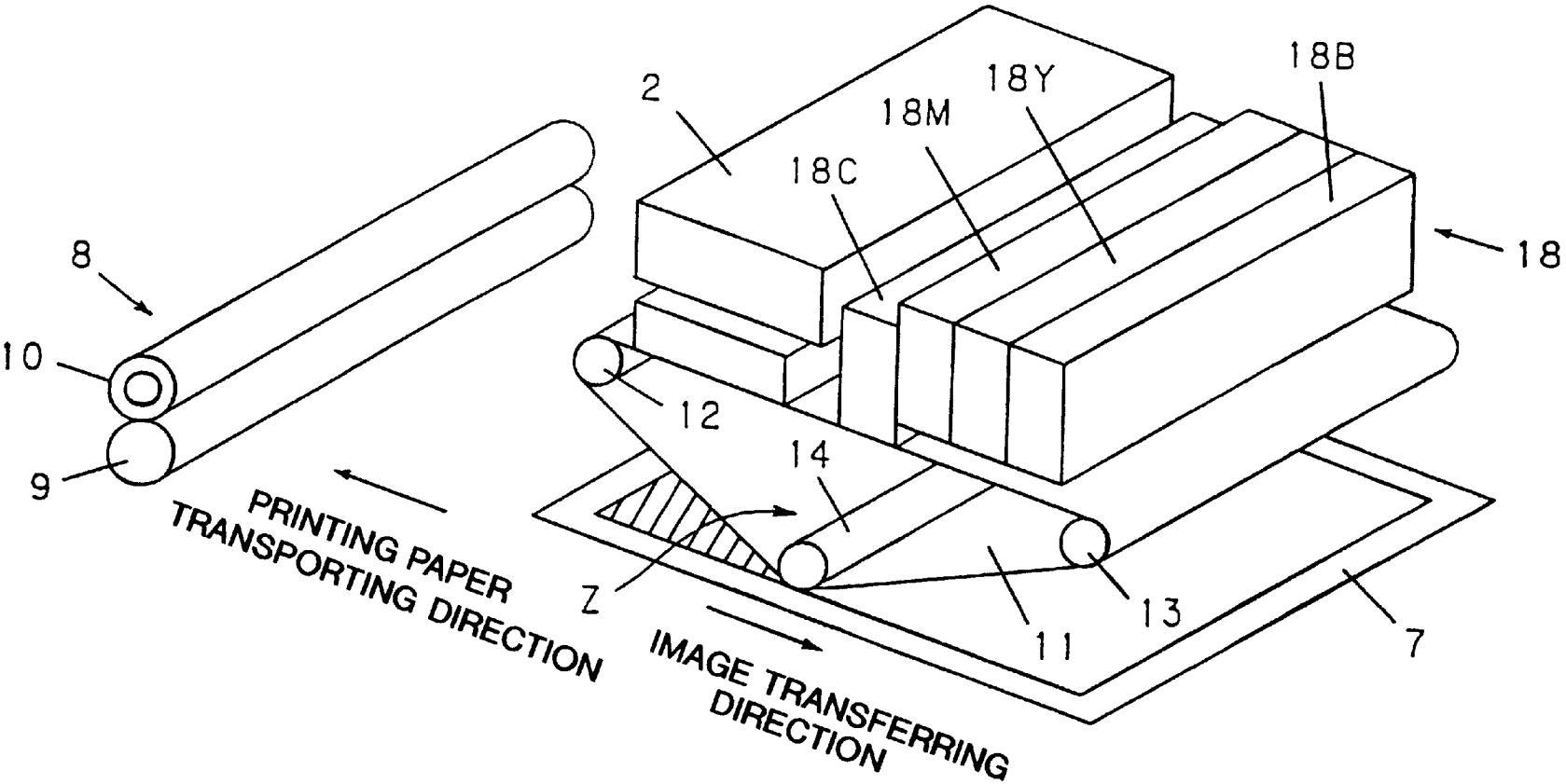
FIG. 2 is a perspective view of the transferring process of an image forming device in an exemplary embodiment of the present invention.
Figure 3:
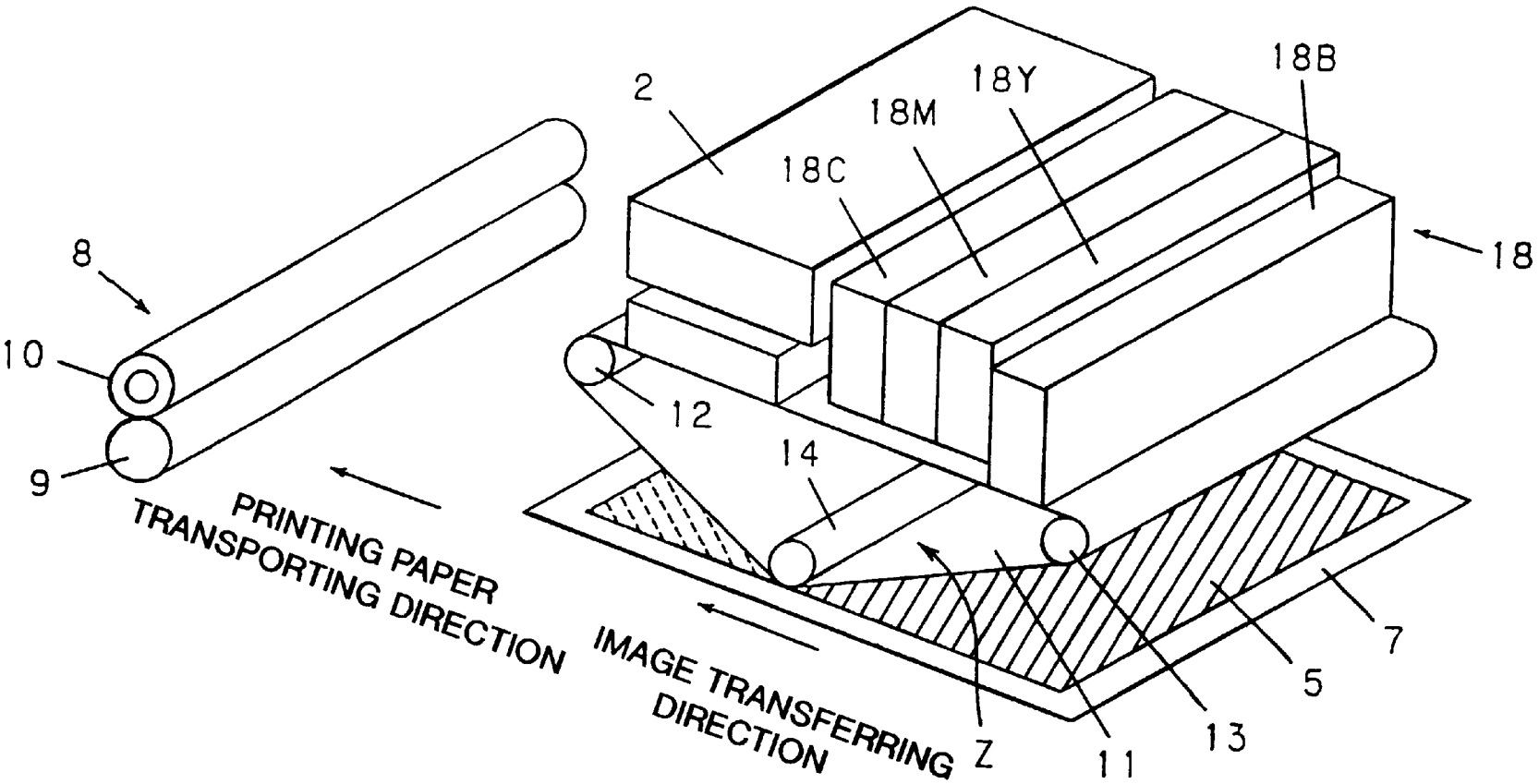
FIG. 3 is another perspective view of the transferring process of an image forming device in an exemplary embodiment of the present invention.
Figure 6:
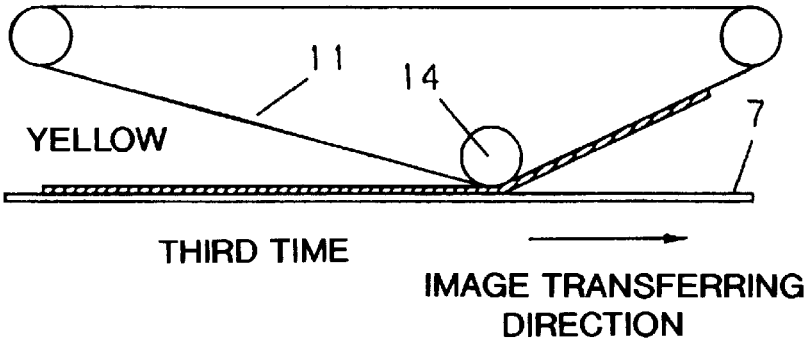
FIG. 6 is still another diagrammatic sketch showing the state of transferring of an image in an exemplary embodiment of the present invention.
Figure 7:
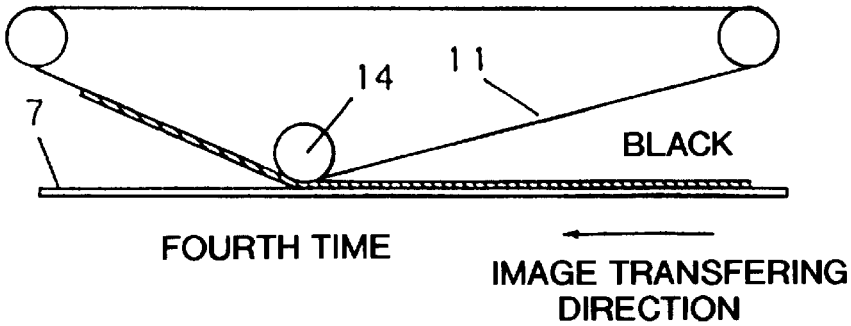
FIG. 7 is still another diagrammatic sketch showing the state of transferring of an image in an exemplary embodiment of the present invention.
Figure 8:
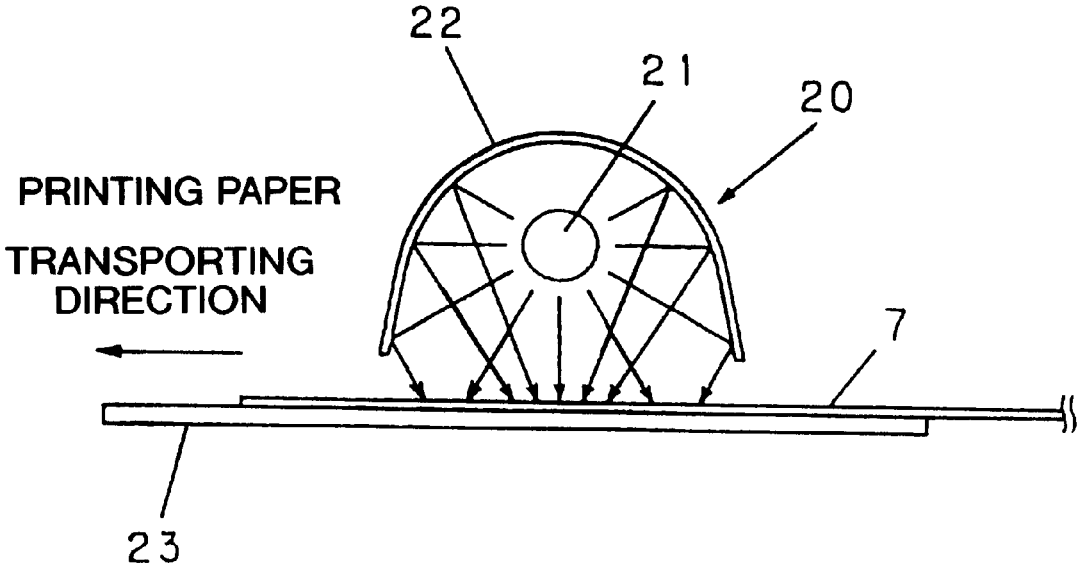
FIG. 8 is a diagrammatic sketch of the image fixing means of an image forming device in an exemplary embodiment of the present invention.
Figure 9:
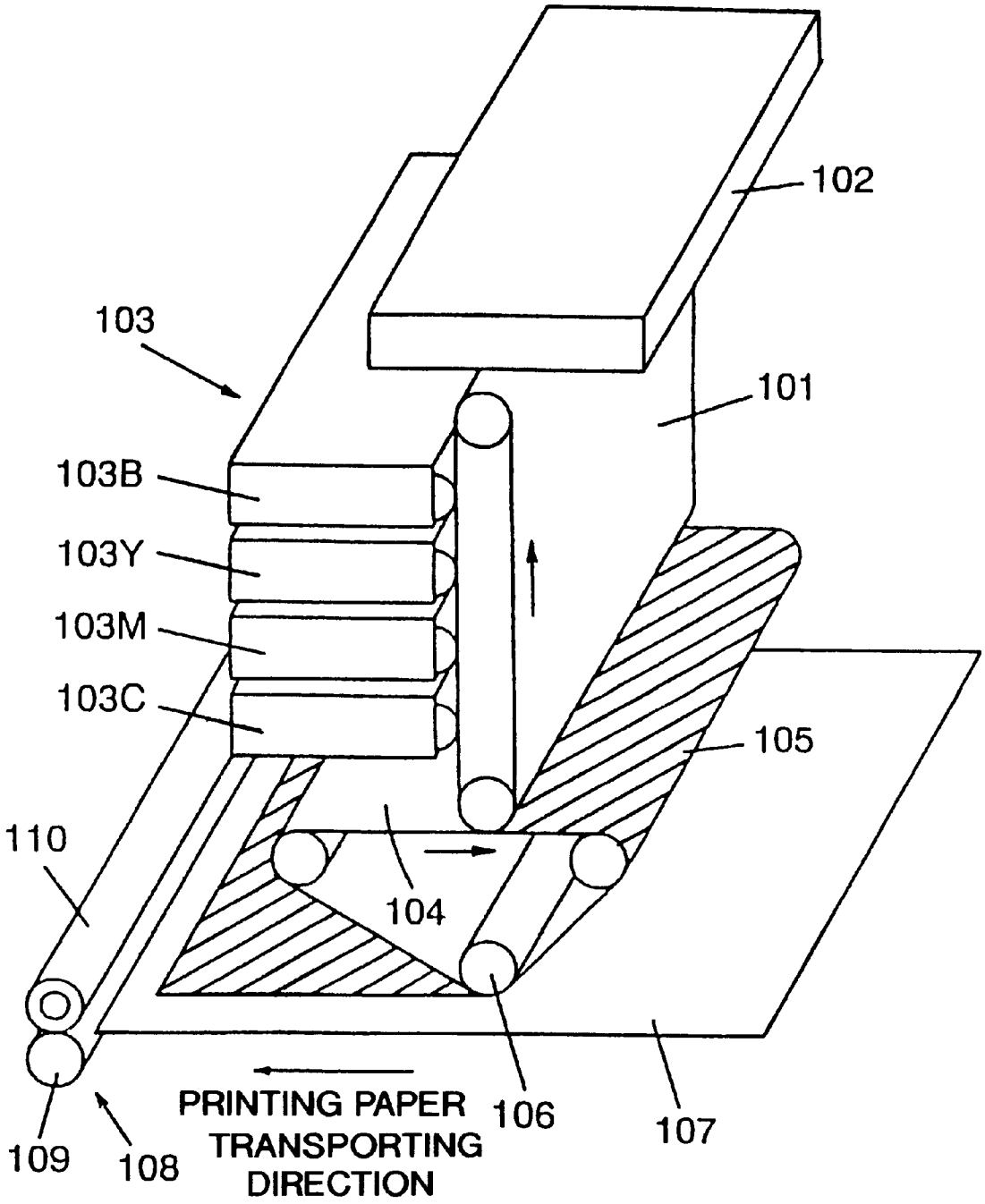
FIG. 9 PRIOR ART
FIG. 9 is a perspective view showing the state of transferring of a prior art image forming device.

FIG. 1 is a schematic diagram of an image forming device in an exemplary embodiment of the present invention. FIG. 2 is a perspective view of the go transferring process of an image forming device in an exemplary embodiment of the present invention. FIG. 3 is another perspective view of the go transferring process of an image forming device in an exemplary embodiment of the present invention. FIG. 4 to FIG. 7 show diagrammatic sketches of the state of transferring of an image in an exemplary embodiment of the present invention. FIG. 8 is a diagrammatic sketch of the image fixing means of an image forming device in an exemplary embodiment of the present invention.

In FIG. 1 to FIG. 3, an endless loop-like belt shaped toner image transporting member 11 formed of a photosensitive belt, the surface of which is coated with a layer of an organic photoconductive material, is installed by stretching in the same direction as a printing paper 7 serving as a record medium is transported by means of a plurality of rollers such as a supporting roller 12, a displacement roller 13, an opposed transferring roller 14 and the like, and a toner image of a primary color is formed on the surface of the toner image transporting member 11 by having the toner image transporting member 11 rotated in the direction indicated by an arrow "X". A charging means 15, a cleaning means 16, a discharging means 17 and the like are arranged surrounding the toner image transporting member 11. Furthermore, in the surroundings of the toner image transporting member 11 are arranged a toner attaching means 18 for a plurality of colors, including a cyan image developing means 18C, a magenta image developing means 18M, a yellow image developing means 18Y and a black image developing means 18B, in such a way as each respective image developing means can move into contact with or off the toner image transporting member 11 and also in the rotational direction of the toner image transporting member 11. The image developing means 18C, 18M, 18Y and 18B for respective colors have an exclusive image developing roller 18*r*, respectively. In addition, a light exposure making means 2 for irradiating laser light is located above the toner image transporting member 11. In this exemplary embodiment of the invention, the description will be made of a case where laser light is used as a typical light source for the light exposure making means 2, but light from on LED or on LCD instead of laser light can also be used in the light exposure making means 2. When the toner image transporting member 11 is rotated in the same direction as indicated by the arrow "X" in FIG. 1 and as the printing paper 7 is transported, the area on the toner image transporting member 11 that has passed the charging means 15 is uniformly charged to about −600 V. The light exposure making means 2 irradiates the surface of the toner image transporting member 11 with laser light for each respective color according to the image signals for the four primary colors, i.e., cyan, magenta, yellow and black. Then, the potential of the area irradiated by the laser light is increased to around −100 V and an electrostatic latent image for each respective primary color is formed on the surface of the toner image transporting member 11. Only one image developing means of the toner image attaching means 18 for the plurality of colors, which corresponds to the laser light irradiated, is brought into contact with the foregoing area, where the above electrostatic latent image has been formed, and a toner image of a specific color, which has now become visible, is formed on the toner image transporting member 11 by having the image developing roller 18r pressed down on the toner. This process is repeated for each respective color involved, thereby toner images of different colors being developed one after another.

As shown in FIG. 1 to FIG. 3, the toner attaching means 18 for a plurality of colors has four image developing means 18C, 18M, 18Y and 18B corresponding to each respective primary color involved, and each of the four image developing means can move into contact with or off the toner image transporting member 11 as described before. However, it is also possible for the image developing means to use a method of jumping image development, whereby the image developing is performed without any contact with the toner image transporting member 11 and the like. Thus, according to the present invention, the "moving into contact" as used in the developing means' capability of moving into contact or off the toner image transporting member 11 should be interpreted as including the meaning of "moving into the vicinity". A toner image of each of the four primary colors, i.e., cyan, magenta, yellow and black, is formed on each respective image developing roller 18*r* by the use of the toner of primary colors as carried in each of the cyan image developing means 18C, magenta image developing means 18M, yellow image developing means 18Y and black image developing means 18B.

Incidentally, as widely known, a black color can be produced from the toner of three primary colors of cyan, magenta and yellow without relying on the black toner and therefore it is possible for the toner attaching means 18 for a plurality of colors to be formed of three image developing means of cyan image developing means 18C, magenta image developing means 18M and yellow image developing means 18Y Also, in addition to the four primary colors of cyan, magenta, yellow and black, image developing means for such relatively frequently used colors as light cyan, light magenta and the like can be used, thereby providing as many as six different colors and the like to the toner attaching means 18 for a plurality of colors.

In the exemplary embodiment as described in the above, the toner attaching means 18 for a plurality of colors is installed on the main body of the image forming device by the number as required according to the variety of colors used, but it is also possible for the image forming device to install only one image developing means by employing a detachable/attachable image developing means holder, thereby allowing a user of the image forming device to form a colored toner image by exchanging the toner attaching means 18 for a plurality of colors whenever it becomes necessary.

Furthermore, in the foregoing arrangement, where a user exchanges the toner attaching means 18 for a plurality of colors, it is also possible for the user to form a monochrome toner image such as a black and white toner image and the like without exchanging the toner attaching means 18 for a plurality of colors.

When a toner image for one color is transferred onto a printing paper 7, the printing paper 7 is made stationary on a transferring plate 19 and also the rotation of the toner image transporting member 11 is suspended as shown in FIG. 2 and FIG. 3. The area of the toner image transporting member 11, where a toner image for one color has been formed, is pressed down onto the printing paper 7 by rolling the opposed transferring roller 14 on the back side of the toner image transporting member 11 to perform an transferring process of the toner image, and then the toner image transporting member 11 is displaced by an extent corresponding to one step of processing from the left end or right end in the reversed direction. At this time, the transferring ended area "Z" of the toner image transporting member 11, where transferring of a toner image for one color has been finished, is taken off, step by step, from the printing paper 7 with the passing of the opposed transferring roller 14. During the step of image transferring, a positive voltage is being applied to the transferring plate 19, on which the printing paper 7 is placed; thereby attracting the negatively charged toner image and peeling off the same from the surface of the toner image transporting member 11 and having the toner image transferred onto the printing paper 7. This process of transferring the toner image from the toner image transporting member 11 is performed not only in the go direction as described in the above (see FIG. 2) but also can be performed in the return direction. (See FIG. 3) At this time, the toner image transporting member 11 is displaced on the printing paper 7 in the same direction as the printing paper 7 is transported.

As shown in FIG. 1, the cleaning means 16 eliminates the toner that has remained on the surface of the toner image transporting member 11 by the use of a cleaning blade or a cleaning brush and reclaim the toner for recycling, thus cleaning the surface of the toner image transporting member 11 physically. The discharging means 17 neutralizes the negative charges that have remained on the surface of the toner image transporting member 11 after the residual toner was removed, thus cleaning the surface of the toner image transporting member 11 electrically. However, the installation of the discharging means 17 is not mandatory.

As shown in FIG. 2, after the image transferring for the first one color portion has been finished, the same process is repeated for the remaining colors. As shown in FIG. 3, a colored toner image 5 formed of the four primary colors is finally formed on the printing paper 7, and upon completion of the image transferring for the four colors the printing paper 7 is transported to an image fixing means 8.

Accordingly, the present exemplary embodiment makes it possible for the toner image on the toner image transporting member 11 to be directly transferred onto the printing paper 7 for each respective color, thus eliminating the need for an intermediate image transferring member in contrast to the prior art example. As a result, the mechanism involved is made simple and the main body of the image forming device can be made small in size. The image transferring efficiency for each transfer of toner image is about 90% at present, and the ultimate image transferring efficiency of 90% is being maintained by the direct image transferring performed from the toner image transporting member 11 onto the printing paper 7 without the use of an intermediate image transferring member. With a prior art image forming device, a needed two-time image transferring operation with a 90% image transferring efficiency for each time has resulted in a reduction to 81% in the ultimate image transferring efficiency. In contrast, the darkness of an image formed on a printing paper 7 according to an exemplary embodiment of the present invention has obviously been increased greatly.

Figure 4:
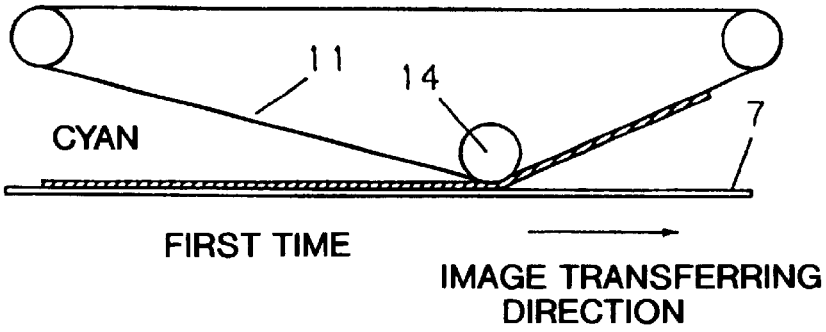
FIG. 4 is a diagrammatic sketch showing the state of transferring of an image in an exemplary embodiment of the present invention.
Figure 5:
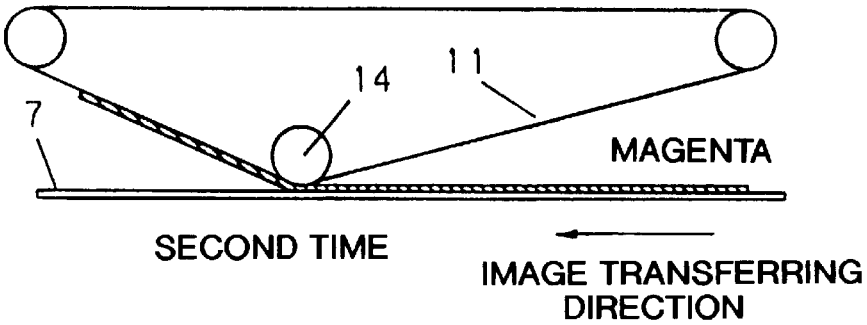
FIG. 5 is another diagrammatic sketch showing the state of transferring of an image in an exemplary embodiment of the present invention.

An image forming method for forming a colored toner image onto a stationary printing paper 7 starts with the state as illustrated in FIG. 4, in which a first step of transferring a toner image in {cyan} only takes place. Next, as illustrated in FIG. 5, a second step of transferring a toner image in {magenta} takes place, thereby the toner image in magenta being superimposed on the toner image in cyan on the printing paper 7. Similarly, a third step of transferring a toner image in {yellow} takes place, resulting in a superimposing of the toner image in yellow upon the images in cyan and magenta, as illustrated in FIG. 6. Finally, a fourth step of transferring a toner image in {black} takes place, thus forming a colored toner image on the printing paper 7 with the toner images formed in {cyan, magenta, yellow and black}, as illustrated in FIG. 7.

After having repeated the foregoing steps, the printing paper 7 is transported slowly to the image fixing means 8, in which the printing paper 7 with a toner image transferred thereon is sandwiched between a pressure applying roller 9 and a heat applying roller 10 with a heat source provided inside, thereby having the toner image fixed on the printing paper 7 by melting the toner particles into place, as illustrated in FIG. 3.

It is also possible to employ an image fixing means as shown in FIG. 8. In FIG. 8, an image fixing means 20 has a heat source 21 and a first reflecting plate 22, and there is a second reflecting plate 23 installed underneath the image fixing means 20. This structure allows the thermal efficiency to be enhanced and the toner to be fixed in a non-contact manner.

As described in the above, a series of the image forming steps come to an end.

In the present exemplary embodiment, a photosensitive image developing means has been employed to form a toner image transporting member, but in place of the photosensitive image developing means (a) a heat-sensitive image developing means, by which a toner image is formed through developing an electrostatic latent image by the use of a heat source, or (b) a wood-block print like image forming means, by which toner is applied all over the surface of a toner transporting member by the use of an image developing means and then the toner is blown away from the toner transporting member to have a toner image formed as if a wood-block image is carved, can also be adopted.

INDUSTRIAL APPLICABILITY

According to the structure disclosed by the present invention, it is made possible for an image forming device to eliminate a bulky intermediate image transferring member that was indispensable to a prior art image forming device. As a result, the construction of the image forming device itself has become simple, thus making it possible to reduce the size of the image forming device. The image transferring efficiency for each toner transferring process is about 90% and the image forming method of the present invention does not employ an intermediate image transferring member since a toner image is directly transferred from a toner image transporting member onto a printing paper with a resulting reduction in the number of image transferring steps, thereby preventing the degradation of the ultimate toner image transferring efficiency and contributing to marked enhancement of the darkness of the printed image.

What is claimed is:

1. An image forming device comprising:

a plurality of rollers;

a loop-like belt shaped toner image transporting belt supported by said plurality of rollers;

colored toner to have colored toner images transported on said toner image transporting belt; and an opposed image transferring roller installed on an inner side of said loop-like belt shaped toner image transporting belt, wherein said toner image transporting belt is made rotatable in the same direction as a record medium in transit is transported and said colored toner images transported on the outer surface of said toner image transporting belt are transferred onto said record medium by the use of said opposed image transferring roller while the rotation of said toner image transporting belt being suspended.

2. The image forming device according to claim 1, further comprising an image fixing means for fixing said colored toner image transferred onto said record medium.

3. The image forming device according to claim 1, wherein said record medium is a printing paper.

4. The image forming device according to claim 1, wherein said toner image transporting belt has at least one image developing means selected from the group consisting of a photosensitive image developing means, a heat-sensitive image developing means and a wood-block print type image developing means.

5. An image forming device comprising:

(a) a loop-like belt shaped toner image transporting belt for transporting a toner image, set up in such a way as rotatable in the same direction as a record medium in transit is transported;

(b) a plurality of rollers that support and make rotatable said toner image transporting belt;

(c) a toner attaching means for having colored toner attached and having a colored toner image transported on the outer surface of said toner image transporting belt, where said toner attaching means moves toward said toner image transporting belt; and (d) an opposed image transferring roller installed on the inner side of said toner image transporting belt so as to have said toner image transporting belt pressed onto said record medium and to make the same movable, and provided with the function of transferring said colored toner image, which has been transported on said toner image transporting belt, onto said record medium.

6. The image forming device according to claim 5, wherein while the rotation of said toner image transporting belt being suspended said opposed image transferring roller presses said toner image transporting belt onto said record medium while moving and said colored toner image is transferred onto said stationary record medium.

7. An image forming device of claim 5 wherein said toner attaching means move toward said toner image transporting belt one after the other.

8. An image forming device comprising:

(a) a loop-like belt shaped toner image transporting belt for transporting a toner image, said toner image transporting belt being installed so as to be rotatable in the same direction as a record medium is transported;

(b) a plurality of rollers that support and make rotatable said toner image transporting belt;

(c) a plurality of toner attaching means that moves toward said toner image transporting belt along a rotational direction of said toner image transporting belt so as to have a plurality of colored toner images, each of which has a color different from others, attached and transported on an outer surface of said toner image transporting belt, for having the plurality of colored toner images transported; and (d) an opposed image transferring roller installed on the inner side of said toner image transporting belt so as to have said toner image transporting belt pressed onto said record medium and to make the same movable, and provided with the function of transferring said plurality of colored toner images, which have been transported on said toner image transporting belt, onto said record medium and forming a composite color image.

9. The image forming device according to claim 8, wherein said plurality of colored toner images have at least two colors selected from the group consisting of cyan, magenta, yellow and black.

10. The image forming device according to claim 8, wherein said plurality of colored toner images have at least two colors selected from the group consisting of two kinds of cyan with the darkness thereof differing from each other and two kinds of magenta with the darkness thereof differing from each other.

11. An image forming device comprising:

(a) a loop-like belt shaped toner image transporting belt for transporting a toner image, said toner image transporting belt being installed so as to be rotatable in the same direction as a record medium is transported;

(b) a plurality of rollers that support and make rotatable said toner image transporting belt;

(c) a plurality of toner attaching means that moves toward said toner image transporting belt along the rotational direction of said toner image transporting belt so as to have a plurality of colored toner image, each of which has a color different from others, attached and transported on the outer surface of said toner image transporting belt, for having a plurality of colored toner images transported; and (d) an opposed image transferring roller installed on the inner side of said toner image transporting belt so as to have said toner image transporting belt pressed onto said record medium and to make the same moveable, and provided with the function of transferring said plurality of colored toner images, which have been transported on said toner image transporting belt, onto said record medium and forming a composite color image, wherein while the rotation of said toner image transporting belt being suspended said opposed image transferring roller presses said toner image transporting belt onto said record medium while moving, and each respective colored toner image out of said plurality of colored toner images is transferred one after another onto said stationary record medium.

12. An image forming device of claim 11, wherein the transferring process is repeated for each respective color until all colors of the plurality of colors are transferred on said record medium, said plurality of color toner images transferred on said record medium are fixed by an image fixing means.

13. An image forming device comprising:

(a) a loop-like belt shaped toner image transporting belt for transporting a toner image, said toner image transporting belt being installed so as to be rotatable in the same direction as a record medium is transported;

(b) a plurality of rollers that support and make rotatable said toner image transporting belt;

(c) a plurality of toner attaching units that moves toward said toner image transporting belt along the rotational direction of said toner image transporting belt so as to have a plurality of colored toner images, each of which has an image developing roller and a color different from others, attached and transported on the outer surface of said toner image transporting belt, for having a plurality of colored toner images transported; and (e) an opposed image transferring roller installed on the inner side of said toner image transporting belt so as to have said toner image transporting belt pressed onto said record medium and to make the same movable, and provided with the function of transferring said plurality of colored toner images, which have been transported on said toner image transporting belt, onto said record medium and forming a composite color image, wherein at least one of said plurality of toner attaching units is installed in such a way as being detachable and attachable and while the rotation of said toner image transporting belt is suspended said opposed image transferring roller presses said toner image transporting belt onto said record medium while moving, and each respective colored toner image out of said plurality of colored toner images is transferred one after another onto said stationary record medium.

14. An image forming device of claim 13 wherein said toner attaching units further comprises an image developing roller.

15. An image forming method comprising the steps of:

(a) having a first colored toner image out of a plurality of colored toner images of the colors different from one another on a surface of a rotatable loop-like toner image transporting belt; and (b) transferring said first colored toner image from said toner image transporting belt onto a record medium, while the rotation of said toner image transporting belt is suspended, by having said toner image transporting belt pressed down and moved in rolling to form a first composite color image on a surface of said record medium, wherein said toner image transporting belt being made rotatable in the same direction as said record medium is transported.

16. The image forming method according to claim 15, further comprising the steps of:

(c) having a second colored toner image out of said plurality of colored toner images on said surface of said toner image transporting belt;

(d) transferring said second colored toner image from said toner image transporting belt onto said record medium so as to be superimposed on said first composite color image, while said rotation of said toner image transporting belt being suspended, by having said toner image transporting belt pressed down and moved in rolling to form a second composite color image on said surface of said record medium;

(e) having a third colored toner image out of said plurality of colored toner images on said surface of said toner image transporting belt; and (f) transferring said third colored toner image from said toner image transporting belt onto said record medium so as to be superimposed on said second composite color image, while said rotation of said toner image transporting belt being suspended, by having said toner image transporting belt pressed down and moved in rolling to form a third composite color image on said surface of said record medium.

17. The image forming method according to claim 16, further comprising the steps of:

(g) having a fourth colored toner image out of said plurality of colored toner images on said surface of said toner image transporting belt; and (h) transferring said fourth colored toner image from said toner image transporting belt onto said record medium so as to be superimposed on said third composite color image, while said rotation of said toner image transporting belt being suspended, by having said toner image transporting belt pressed down and moved in rolling to form a fourth composite color image on said surface of said record medium.

18. The image forming method according to claim 15, further comprising the steps of:

(c) transporting a second colored toner image out of said plurality of colored toner images on said surface of said toner image transporting belt;

(d) transferring said second colored toner image from said toner image transporting belt onto said record medium so as to be superimposed on said first composite color image, while said rotation of said toner image transporting belt being suspended, by having said toner image transporting belt pressed down and moved in rolling to form a second composite color image on said surface of said record medium; and (e) forming a composite color image on said surface of said record medium by repeating said step (c) and step (d) multiple times.

19. The image forming method according to claim 18, wherein said plurality of colored toner images have at least one color selected from the group consisting of a plurality of kinds of cyan with the darkness thereof differing from one another and a plurality of kinds of magenta, yellow and black with the darkness thereof differing from one another.

20. The image forming method according to claim 15, wherein each respective color of said plurality of colored toner images has at least one color selected from the group consisting of cyan, magenta, yellow and black.

21. The image forming method according to claim 15, wherein each respective colored toner image of said plurality of colored toner images is transferred onto said record medium that is standing still.

22. The image forming method according to claim 15, further comprising the step of fixing said first composite color image, third composite color image, fourth composite color image and one out of said composite color images.

23. An image forming method of claim 13, further comprising the steps of;

(c) repeating the transferring process of steps (a) and (b) for each of the respective colors of the plurality of colors until the number of colors required to form a color image on said record medium is complete, and (d) fixing said color image transferred on said record medium by an image fixing means.

* * * * *

UNITED STATES PATENT AND TRADE MARK OFFICE

CERTIFICATE OF CORRECTION

PATENT NO. : 6,085,057
DATED : July 4, 2000
INVENTOR(S) : Matsuzoe et al.

It is certified that error appears in the above-identified patent and that said Letters Patent is hereby corrected as shown below:

Column 12, line 22, delete "13" and insert --15--.

Signed and Sealed this

First Day of May, 2001

Nicholas P. Godici

*Attest:*

NICHOLAS P. GODICI

*Attesting Officer*

*Acting Director of the United States Patent and Trademark Office*